US008305332B2

(12) United States Patent
Park et al.

(10) Patent No.: US 8,305,332 B2
(45) Date of Patent: Nov. 6, 2012

(54) BACKLIGHT UNIT, LIQUID CRYSTAL DISPLAY DEVICE INCLUDING THE SAME, AND LOCALIZED DIMMING METHOD THEREOF

(75) Inventors: Mun-Soo Park, Suwon-si (KR); Gun-Woo Moon, Daejeon (KR); Won-Sik Oh, Daegu (KR); Dae-Youn Cho, Daejeon (KR); Kyu-Min Cho, Daegu (KR); Nam-Deog Kim, Yongin-si (KR); Seung-Hwan Moon, Yongin-si (KR)

(73) Assignees: Samsung Display Co., Ltd., Yongin, Gyeonggi-Do (KR); Korea Advanced Institute Science & Technology, Yuseong-Gu, Daejeon (KR)

( * ) Notice: Subject to any disclaimer, the term of this patent is extended or adjusted under 35 U.S.C. 154(b) by 858 days.

(21) Appl. No.: 12/188,836

(22) Filed: Aug. 8, 2008

(65) Prior Publication Data

US 2009/0058792 A1 Mar. 5, 2009

(30) Foreign Application Priority Data

Aug. 30, 2007 (KR) ..... 10-2007-0087809

(51) Int. Cl.
*G09G 3/36* (2006.01)

(52) U.S. Cl. ..... 345/102; 345/76; 345/77; 315/169.3

(58) Field of Classification Search ..... 345/102, 345/76–82; 349/61, 69; 315/169.3
See application file for complete search history.

(56) References Cited

U.S. PATENT DOCUMENTS

| | | | | |
|---|---|---|---|---|
| 7,864,156 | B2 * | 1/2011 | Okita et al. | 345/102 |
| 2002/0089473 | A1 * | 7/2002 | Yamazaki et al. | 345/75.2 |
| 2002/0159002 | A1 * | 10/2002 | Chang | 349/61 |
| 2003/0038761 | A1 * | 2/2003 | Chen et al. | 345/82 |
| 2005/0179623 | A1 * | 8/2005 | Negoi | 345/76 |
| 2005/0184952 | A1 * | 8/2005 | Konno et al. | 345/102 |
| 2006/0001615 | A1 * | 1/2006 | Kim | 345/76 |
| 2006/0022914 | A1 * | 2/2006 | Kimura et al. | 345/76 |
| 2006/0146005 | A1 * | 7/2006 | Baba et al. | 345/102 |
| 2007/0273678 | A1 * | 11/2007 | Okita et al. | 345/204 |

FOREIGN PATENT DOCUMENTS

| | | |
|---|---|---|
| JP | 2001-142409 | 5/2001 |
| KR | 2004-0067290 | 7/2004 |
| KR | 2004-0096186 | 11/2004 |

* cited by examiner

*Primary Examiner* — Amare Mengistu
*Assistant Examiner* — Dmitriy Bolotin
(74) *Attorney, Agent, or Firm* — F. Chau & Associates, LLC

(57) ABSTRACT

A backlight unit of a liquid crystal display device supplies light to one or more corresponding pixels of a liquid crystal display panel. The backlight unit includes a plurality of blocks formed into a matrix shape. Each block includes a light emitting diode module. The blocks in a row of the matrix are driven by a same row driving signal and the blocks in a column of the matrix are driven by a same column driving signal, to adjust luminance of the light supplied to the corresponding pixels.

12 Claims, 24 Drawing Sheets

| | | | | |
|---|---|---|---|---|
| 171 | 174 | 175 | 172 | 168 |
| 165 | 170 | 172 | 170 | 169 |
| 161 | 176 | [illegible] | 158 | 158 |
| 255 | 252 | 255 | 247 | 153 |
| 73 | 49 | 70 | 70 | 47 |

| | | | | |
|---|---|---|---|---|
| 171 | 174 | 175 | 172 | 168 |
| 166 | 170 | 172 | 170 | 169 |
| 161 | 176 | 201 | 194 | 158 |
| 255 | 252 | 255 | 247 | 153 |
| 73 | 49 | 70 | 70 | 47 |

| | | | | |
|---|---|---|---|---|
| 255 | 255 | 255 | 255 | 255 |
| 255 | 255 | 255 | 255 | 255 |
| 255 | 255 | 255 | 255 | 255 |
| 255 | 255 | 255 | 255 | 255 |
| 255 | 255 | 255 | 255 | 255 |

| | | | | |
|---|---|---|---|---|
| 177 | 174 | 180 | 172 | 171 |
| 175 | 172 | 176 | 170 | 169 |
| 199 | 196 | 202 | 194 | 193 |
| 255 | 252 | 258 | 250 | 249 |
| 91 | 88 | 94 | 86 | 85 |

| | | | | |
|---|---|---|---|---|
| 245 | 255 | 249 | 255 | 251 |
| 252 | 252 | 249 | 255 | 253 |
| 206 | 202 | 254 | 255 | 209 |
| 255 | 255 | 252 | 252 | 157 |
| 205 | 142 | 190 | 208 | 141 |

BACKLIGHT UNIT, LIQUID CRYSTAL DISPLAY DEVICE INCLUDING THE SAME, AND LOCALIZED DIMMING METHOD THEREOF

CROSS-REFERENCE TO RELATED APPLICATION

This application claims priority to Korean patent application 2007-0087809, filed on Aug. 30, 2007, the disclosure of which is incorporated by reference herein.

BACKGROUND OF THE INVENTION

1. Technical Field

The present disclosure relates to a liquid crystal display device, and more particularly, to a localized dimming method of a liquid crystal display device.

2. Discussion of Related Art

Demand for a high-performance display device that displays various kinds of information, such as images, graphics, and text has increased dramatically. Accordingly, display industries have shown rapid growth in recent years.

Thin film transistor ("TFT") liquid crystal display ("LCD") devices have been developed over the years to satisfy this demand. A TFT LCD device has low power consumption, is lightweight, thin, and does not release harmful electromagnetic waves as compared to a cathode ray tube ("CRT") display device.

As compared to a plasma display panel ("PDP") or the CRT display device, which are self emitting light devices, the TFT LCD device includes a TFT array, liquid crystals, and a backlight unit. The TFT array transfers an electric signal, the liquid crystals are rotated according to an applied voltage to transmit light, and the backlight unit is used as a light source at a rear side of the TFT LCD device.

A cold cathode fluorescent lamp ("CCFL") can be used as the backlight unit of a TFT LCD device. The CCFL uses a cathode that does not emit heat and has low power consumption and high luminance.

A CCFL typically uses mercury. However, according to an environmental agreement, use of mercury is prohibited. Therefore, a backlight unit of a flat type that does not require mercury is needed.

A light emitting diode ("LED") backlight unit can be used as a light source for the TFT LCD device, because the LED backlight unit does not use mercury, shows clear picture quality, and has wide color reproducibility for digital broadcasting.

When the LED backlight unit is used as the light source, a localized dimming operation that adjusts brightness of an LED per block according to image information can be implemented, thereby decreasing power consumption and enhancing a contrast ratio of an image.

FIG. 1 is a view showing a conventional LCD device using a CCFL, and FIG. 2A and FIG. 2B are views showing a principle of displaying an image of a conventional LCD device using a CCFL.

Referring to FIG. 1, an LCD device includes a display panel 102 and a backlight unit 101. The display panel 102 includes a TFT array substrate 103, a color filter array substrate 105, and liquid crystals ("LCs") 107 interposed between the TFT array substrate 103 and the color filter array substrate 105. In the LCD device, the transmittance of light 109 transmitted from the backlight unit 101 is adjusted by an electric field applied to the TFT array substrate 103 and the color filter array substrate 105, thereby displaying an image.

The luminance of each pixel of the display panel 102 is determined by multiplying the illumination of the backlight unit 101 by the light transmittance of the LCs. In a conventional LCD device, an image with predetermined luminance is displayed by adjusting the transmittance of the LCs 107 after emitting the light 109 from the backlight unit 101 to the LCs by maximum illumination, as shown in FIG. 2A. However, since the light 109 provided to each pixel is more than necessary, power loss occurs.

A scaling system has been developed to reduce the power consumption. Referring to FIG. 2B, an image may be displayed even though the illumination of the backlight unit 101 is lowered below a maximum illumination. For example, the transmittance of the LCs in a pixel can be maximized by displaying an image having the brightest luminance and appropriately adjusting the transmittance of the LCs in the other pixels according to a ratio of the transmittance of the pixel displaying the image having the brightest luminance to the transmittance of the other pixels. The scaling system may reduce power consumption by lowering the illumination of the backlight unit 101.

FIG. 3 is a view showing a principle of displaying an image of a conventional LCD device using a localized dimming method. In the localized dimming method, the backlight unit 101 includes a plurality of blocks each having a light source and the illumination of the light source is individually adjusted. When the scaling system is applied to the localized dimming method, it is possible to maximize the transmittance of the LCs and to lower the illumination of the light source per block, thereby reducing the power consumption. When each block corresponds to a plurality of pixels, the transmittance of a pixel showing the brightest luminance is set to the maximum and the transmittance of the other pixels is adjusted by comparing the transmittance of the pixel showing the brightest luminance with the transmittance of the other pixels.

The localized dimming method can reduce the power consumption and improve a contrast ratio of the image. However, since an additional driving circuit per block is required to adjust the illumination of the light sources, manufacturing costs are increased.

Thus, there is a need for a backlight device for an LCD device, an LCD device, and a localized dimming method thereof, that can reduce manufacturing costs.

SUMMARY OF THE INVENTION

An exemplary embodiment of the present invention includes a backlight unit of a liquid crystal display device that supplies light to one or more corresponding pixels of a liquid crystal display panel. The backlight unit includes a plurality of blocks. Each block includes a light emitting diode module and the blocks are formed into a matrix shape. The blocks in a row of the matrix are driven by a same row driving signal and the blocks in a column of the matrix are driven by a same column driving signal, to adjust luminance of the light supplied to the corresponding pixels.

An exemplary embodiment of the present invention includes a liquid crystal display device including a display panel, a panel driver, a backlight unit, and a backlight unit driver. The display panel comprises a plurality of pixels formed into a matrix shape. and the display panel adjusts transmittance of liquid crystals according to a driving signal applied to the pixels to display an image. The panel driver transmits the driving signal to the pixels of the display panel. The backlight unit includes a plurality of blocks formed into a matrix shape and supplies light to at least one of the corresponding pixels. Each block includes a light emitting diode.

The backlight unit driver includes a plurality of row driving circuits that transmit a same driving signal to the blocks belonging to a same row of the backlight unit, and a plurality of column driving circuits that transmit a same column driving signal to the blocks belonging to a same column of the backlight unit.

An exemplary embodiment of the present invention includes a localized dimming method of a liquid crystal display device that includes a backlight unit. The backlight unit includes a plurality of blocks formed into a matrix shape and supplies light to at least one corresponding pixel of a display panel. Each block includes a light emitting diode module. The method includes driving the blocks in a row of the matrix using a same row driving signal and driving the blocks in a column of the matrix using a same column driving signal.

BRIEF DESCRIPTION OF THE DRAWINGS

The present invention will become more apparent by describing in detail exemplary embodiments thereof with references to the attached drawings, in which.

DETAILED DESCRIPTION OF EXEMPLARY EMBODIMENTS

Hereinafter, exemplary embodiments of the present invention will be described in detail with reference to the accompanying drawings.

Figure 1:
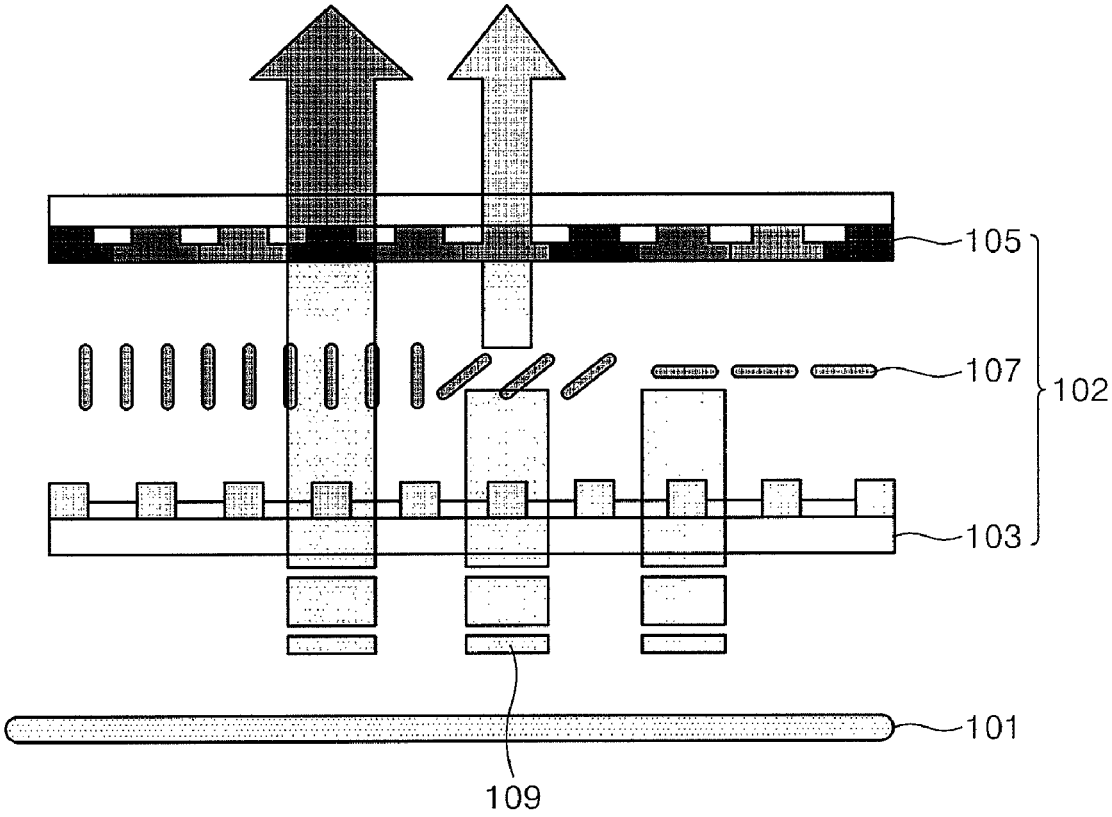
Fig. 1 (Related Art)
FIG. 1 is a view showing a conventional LCD device using a CCFL.
Figure 2A:
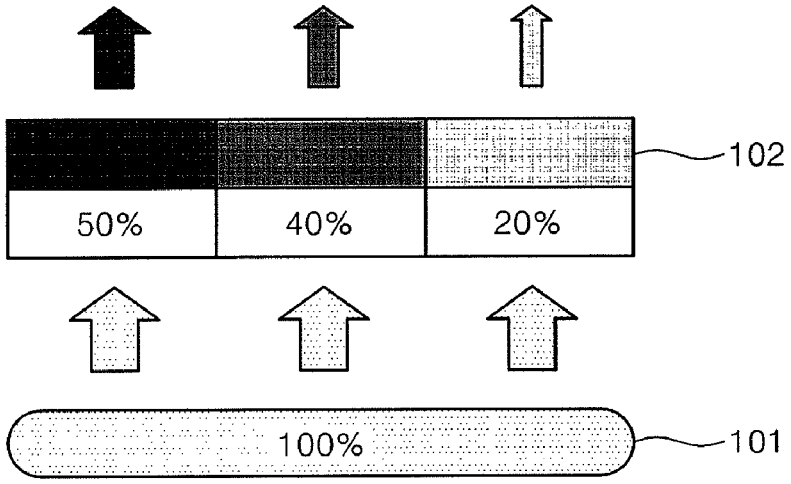
Fig. 2A (Related Art)
FIG. 2A and FIG. 2B are views showing a principle of displaying an image of a conventional LCD device using a CCFL.
Figure 2B:
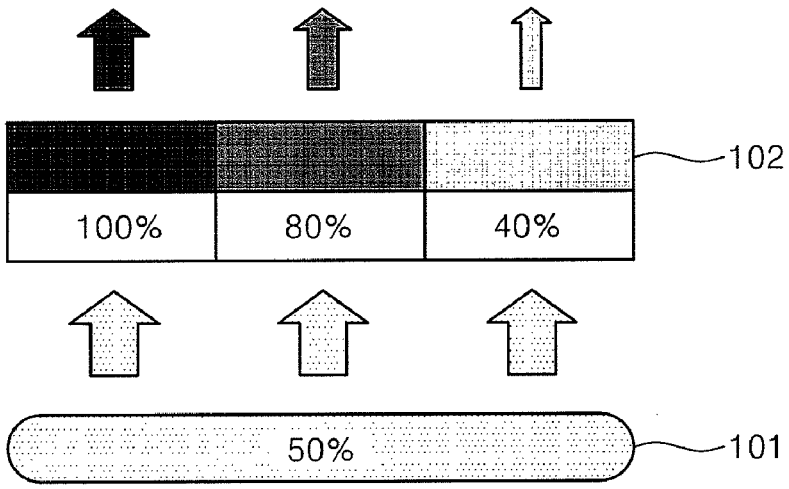
Fig. 2B (Related Art)
Figure 3:
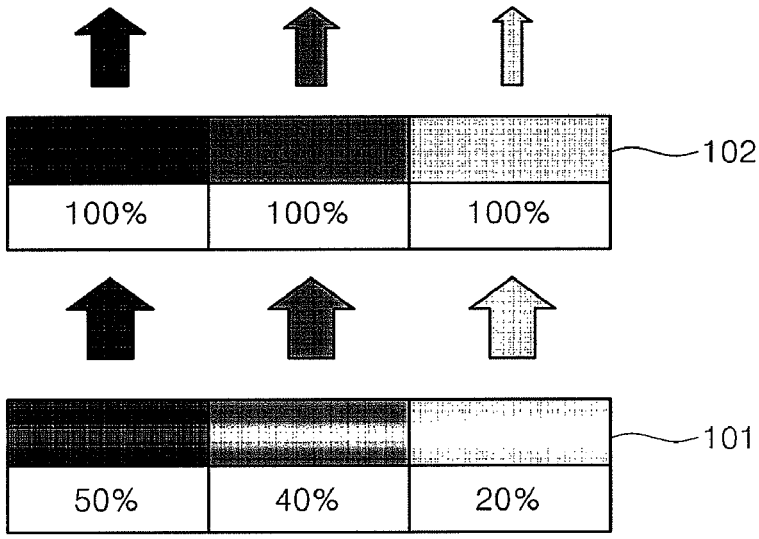
Fig. 3 (Related Art)
FIG. 3 is a view showing a principle of displaying an image of a conventional LCD device using a localized dimming method.
Figure 4:
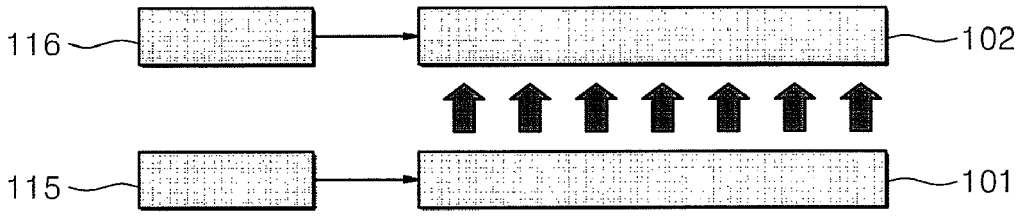
FIG. 4 is a block diagram showing an LCD device according to an exemplary embodiment of the present invention.

FIG. 4 is a block diagram showing an LCD device according to an exemplary embodiment of the present invention. Referring to FIG. 4, an LCD device includes a display panel 102, a panel driver 116, a backlight unit 101, and a backlight unit driver 115.

The display panel 102 includes a plurality of pixels formed into a matrix shape. The display panel 102 displays an image by adjusting the transmittance of LCs (not shown) according to a driving signal supplied to the pixels. The display panel 102 includes a TFT substrate, a color filter substrate, and the LCs are interposed therebetween.

The panel driver 116 transmits a gate driving signal and a data driving signal to the display panel 102 to adjust the transmittance of the LCs.

The backlight unit 101 includes a plurality of blocks formed into a matrix shape. Each block includes an LED module to supply light to one or more corresponding pixels of the display panel 102.

The backlight unit driver 115 includes a plurality of row driving circuits and a plurality of column driving circuits to transmit driving signals to the LED module included in each block of the backlight unit 101.

The row driving circuits transmit the same row driving signal to LED modules in blocks belonging to the same row, and the column driving circuits transmit the same column driving signal to LED modules in blocks belonging to the same column.

Figure 5:
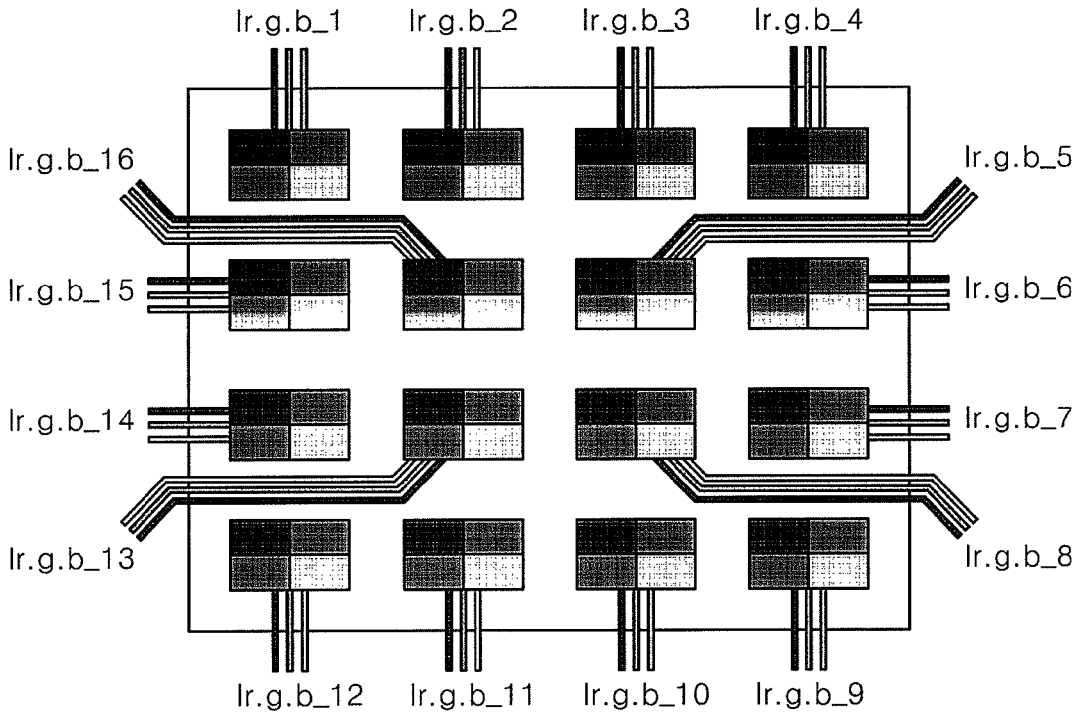
Fig. 5 (Related Art)
FIG. 5 is a view showing a circuit configuration of a backlight unit driver using a conventional localized dimming method.
Figure 6:
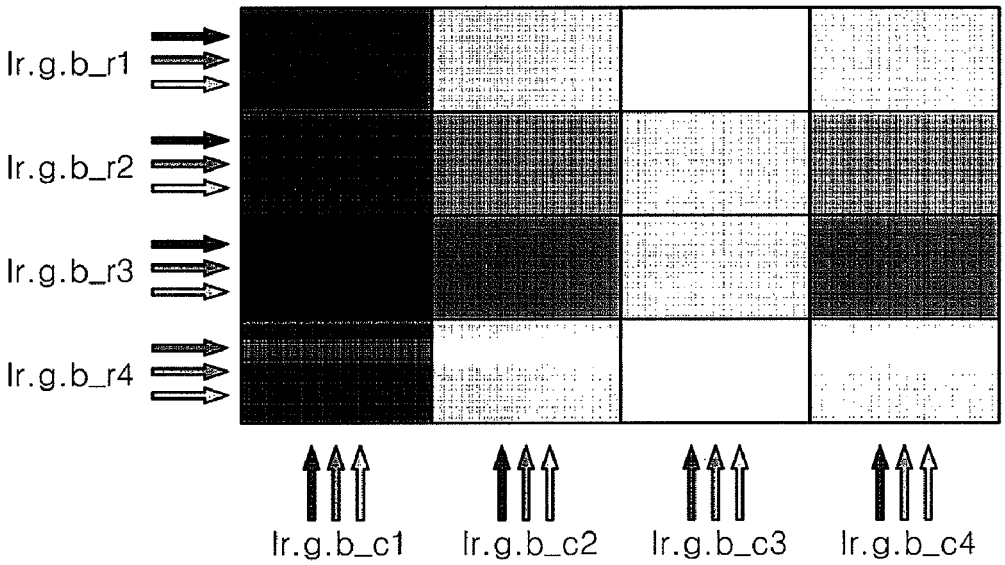
FIG. 6 is a view showing a circuit configuration of a backlight unit driver of an LCD device according to an exemplary embodiment of the present invention.

FIG. 5 is a view showing a circuit configuration of a backlight unit driver using a conventional localized dimming method, and FIG. 6 is a view showing a circuit configuration of a backlight unit driver of an LCD device according to an exemplary embodiment of the present invention. While FIG. 5 and FIG. 6 illustrate a 4-row by 4-column structure, structures of various other row and column arrangements may be applicable.

Referring to FIG. 5, in the conventional localized dimming method, a driving circuit for each block is required. When red (R), green (G), and blue (B) LEDs are used, driving circuits equal to three times the number of rows times the number of columns are needed, for example, 48 driving circuits in FIG. 5 are needed.

However, in a localized dimming method according to an exemplary embodiment of the present invention, the same row driving signal is supplied from the same row driving circuit to blocks belonging to the same row, and the same column driving signal is supplied from the same column driving circuit to blocks belonging to the same column. Each block is driven by a combination of the row driving signal and the column driving signal.

According to the illustrated embodiment of the present invention in FIG. 6, the number of the driving circuits for driving the backlight unit is reduced as compared to the conventional embodiment illustrated in FIG. 5. While 48 driving circuits are required in the conventional localized dimming method, merely 24 driving circuits are required in FIG. 6, according to a localized dimming method of the present invention. When R, G, and B LEDS are used, the number of driving circuits is derived from multiplying the sum of the number of rows and the number of columns by 3.

Figures 7A, 7B:
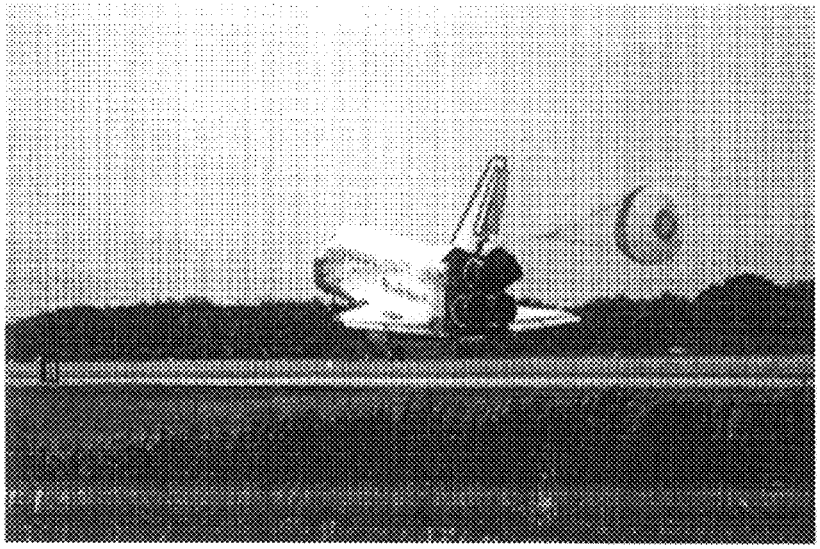
FIG. 7A to FIG. 7B are views showing a process of displaying an image in an LCD device according to an exemplary embodiment of the present invention.

FIG. 7A and FIG. 7B are views for showing a process of displaying an image in an LCD device according to an exemplary embodiment of the present invention. Referring to FIG. 7A, when image data is given, a maximum level data ("MLD") value per block is determined according to the image data. Referring to FIG. 7B, each value represents MLD values of respective blocks. The MLD value means the brightest luminance value among luminance values of pixels corresponding to the respective blocks.

Figures 8A, 8B, 8C:
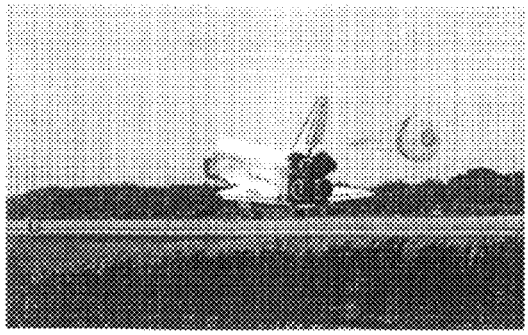
FIG. 8A, FIG. 8B, and FIG. 8C are views showing a process of displaying an image of an LCD device.

FIG. 8A, FIG. 8B, and FIG. 8C are views for showing a process of displaying an image of an LCD device. Referring to FIG. 8A, each value represents the illumination of an LED determined according to each block. Referring to FIG. 8B, each value represents the light transmittance of a pixel having the MLD value among pixels corresponding to respective blocks. A light transmittance of '0' means that light is totally blocked, and a light transmittance of '255' means that light is maximally transmitted. Values in the range of from 0 to 255 are linearly proportional to the light transmittance. Image data shown in FIG. 8C is obtained by the illumination shown in FIG. 8A and the light transmittance shown in FIG. 8B.

The illumination of each block shown in FIG. 8A is determined such that the luminance of the MLD value is expressed when the transmittance of LCs in a pixel having the MLD value is maximum. An image of each pixel in pixels except for the pixel having the MLD value is displayed by adjusting the transmittance of the LCs according to an luminance ratio of the pixel having the MLD value to the pixels not having the MLD value. It is possible to reduce power consumption because the transmittance of the LCs may be maximized and thus the illumination of each the block of a backlight unit may be minimized.

Figures 9A, 9B, 9C:
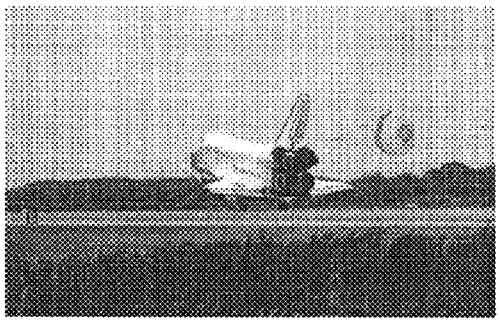
FIG. 9A, FIG. 9B, and FIG. 9C are views showing a process of displaying an image of an LCD device according to an exemplary embodiment of the present invention.

FIG. 9A, FIG. 9B, and FIG. 9C are views showing a process of displaying an image of an LCD device according to an exemplary embodiment of the present invention. Referring to 9A, each value represents the illumination of an LED determined according to each block. Referring to FIG. 9B, each value represents the transmittance of a pixel having the MLD value among pixels corresponding to respective blocks. Image data shown in FIG. 9C is obtained by the illumination shown in FIG. 9A and the light transmittance shown in FIG. 9B.

Determining the illumination of each block as values shown in FIG. 9A can reduce power consumption. Accordingly, an exemplary embodiment of the present invention, determining the illumination of each block closely approximates a value that represents the luminance of a MLD value when the transmittance of LCs is maximized in the pixel having the MLD value.

However, the illumination of all blocks can not be identically adjusted with the values shown in FIG. 9A, because the blocks are driven not by separate driving circuits, but by a row driving circuit for driving blocks belonging to the same row and a column driving circuit for driving blocks belonging to the same column.

When the number of rows is m and the number of columns is n, the number of blocks is M×N. Since the number of driving circuits is M+N, it is difficult to identically adjust the illumination of all the blocks with the values shown in FIG. 9A. However, since the number of the driving circuits may be greatly reduced, manufacturing costs can be reduced.

Figure 10:
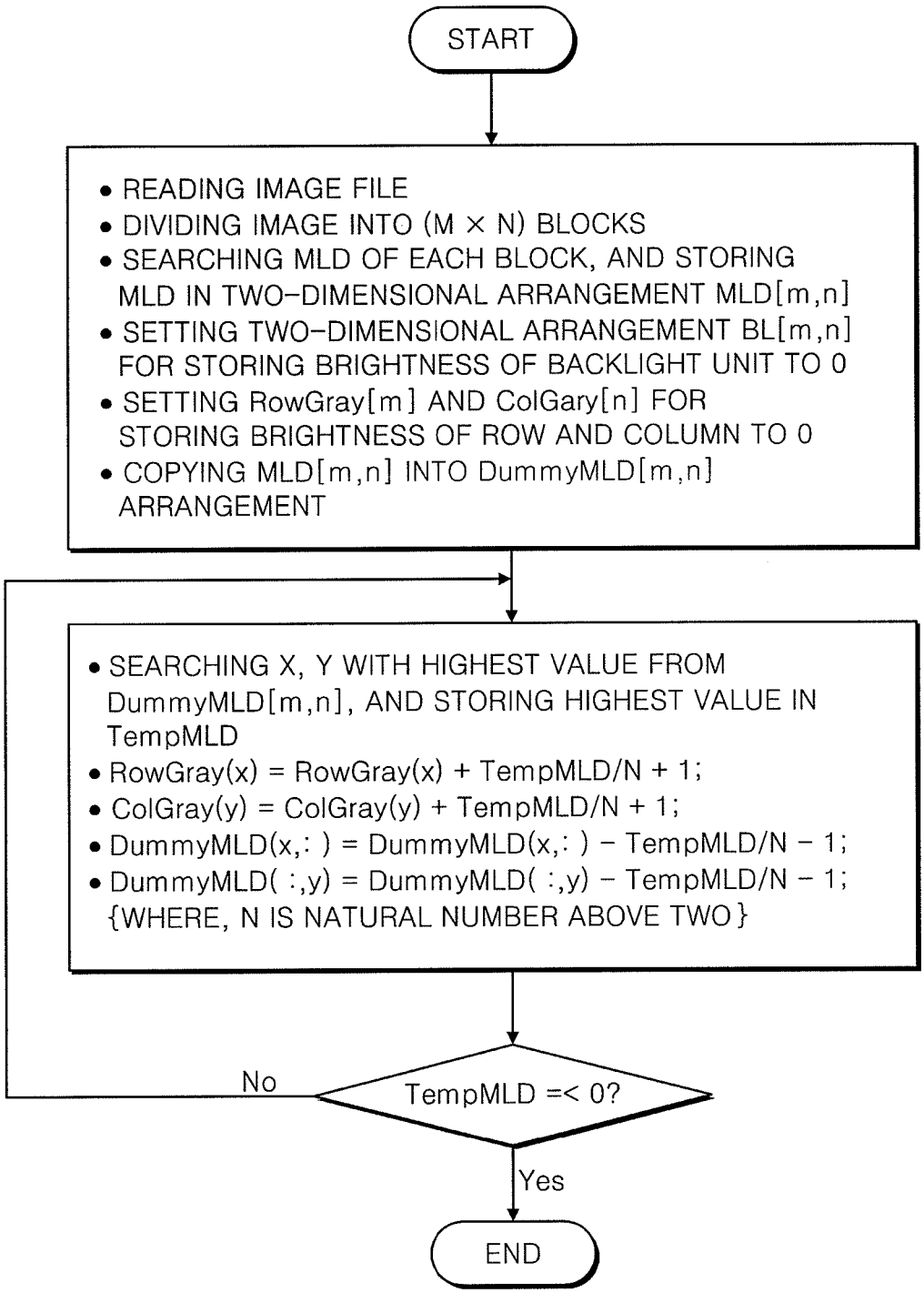
FIG. 10 is a flowchart showing a method for determining illumination of each block according to an exemplary embodiment of the present invention.

FIG. 10 is a flowchart showing a method for determining illumination of each block according to an exemplary embodiment of the present invention.

The illumination of each block as shown in FIG. 9A, e.g., the illumination RowGray of each row, and the illumination ColGray of each column may be obtained by using the flowchart of FIG. 10.

Referring to FIG. 9A, the illumination of each row and column is as follows: 177 in the first row and the first column, 175 in the second row and the first column, 199 in the third row and the first column, 255 in the fourth row and the first column, 91 in the fifth row and the first column, 88 in the fifth row and the second column, 94 in the fifth row and the third column, 86 in the fifth row and fourth column, and 85 in the fifth row and the fifth column. After the row illumination RowGray and the column illumination ColGray are obtained, a corresponding illumination can be achieved by adjusting a voltage, a current, or a voltage or current supplying time in the row driving circuit and the column driving circuit. The row driving circuit and the column driving circuit may drive each block by a current signal or a voltage signal.

Figure 11:
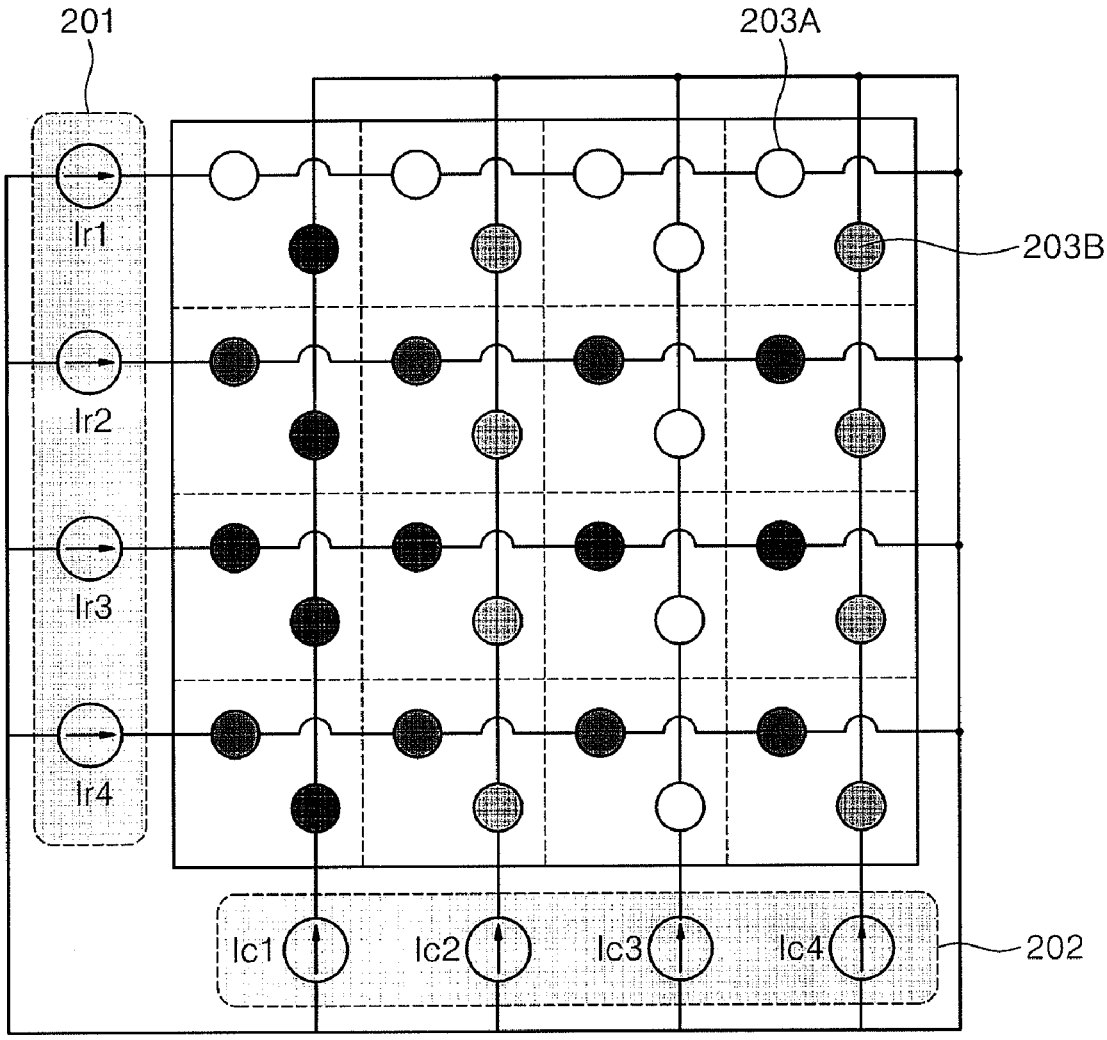
FIG. 11 is a view showing each block driven by a current signal.
Figure 12:
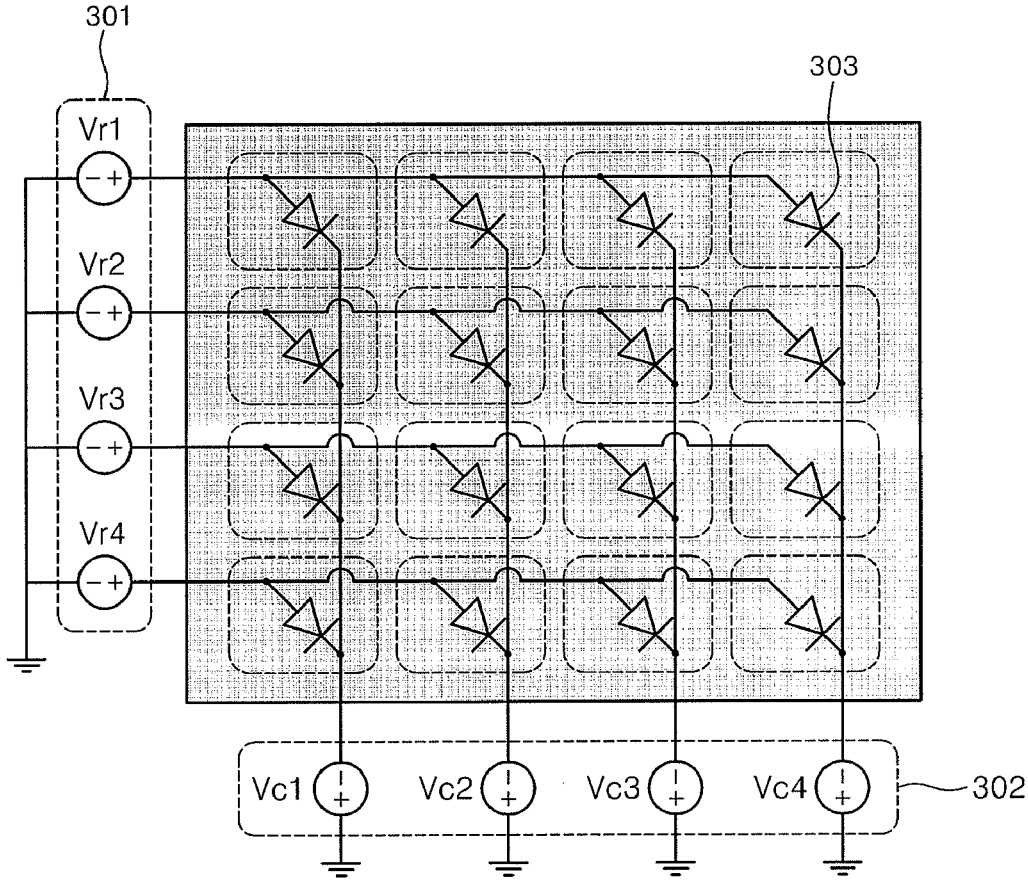
FIG. 12 is a view showing each block driven by a voltage signal.

FIG. 11 shows each block driven by a current signal, and FIG. 12 shows each block driven by a voltage signal. Referring to FIG. 11, when each block is driven by the current signal, two LED modules 203A and 203B per block are provided, and the LED modules 203A and 203B are driven by a row driving circuit 201 and a column driving circuit 202, respectively.

Referring to FIG. 12, when each block is driven by the voltage signal, one LED module 303 per block is prepared, and the LED module 303 is driven by a difference between voltages transmitted from a row driving circuit 301 and a column driving circuit 302. In an alternative exemplary embodiment of the present invention, each block driven by the voltage signal may be equipped with two LED modules driven by a row driving circuit and a column driving circuit.

Figure 13:
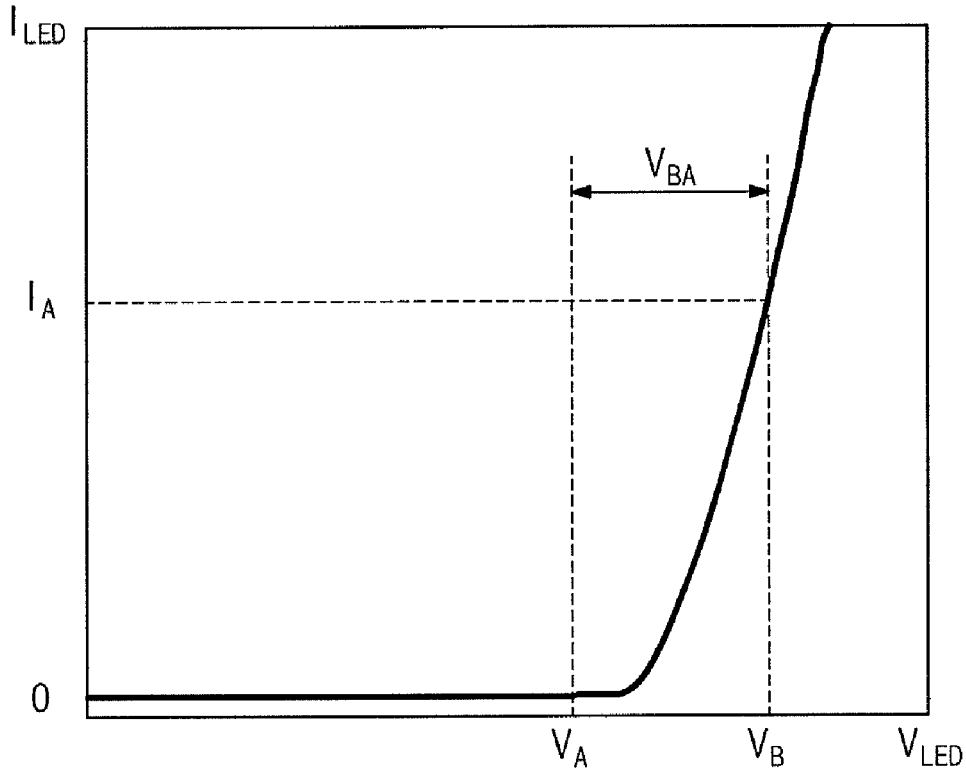
FIG. 13 is a graph showing a voltage-current characteristic of an LED module according to an exemplary embodiment of the present invention.

FIG. 13 is a graph showing a voltage-current characteristic of an LED module according to an exemplary embodiment of the present invention.

Referring to FIG. 13, in the LED module, a current $I_{LED}$ does not linearly increase as a voltage $V_{LED}$ increases, and the current $I_{LED}$ increases when the voltage $V_{LED}$ is above a predetermined voltage. The illumination of the LED module is not proportional linearly to the voltage applied to the LED module. Therefore, it can be difficult to determine the illumination of each block by a combination of voltage signals of the row driving circuit and the column driving circuit when each block is driven by the voltage signal. As a result, methods for providing image correction can be complicated.

A method may be used, in which a time for displaying one image is divided into two durations. The illumination of the LED module may be adjusted by the column driving circuit in a first duration, and by the row driving circuit in a second duration. Hereinafter, such a method will be referred to as a half-period driving method. The sum of the illumination implemented by the row driving circuit and the illumination implemented by the column driving circuit is an illumination of a block during one period. The half-period driving method may be applicable to current and voltage driving.

Figure 14A:
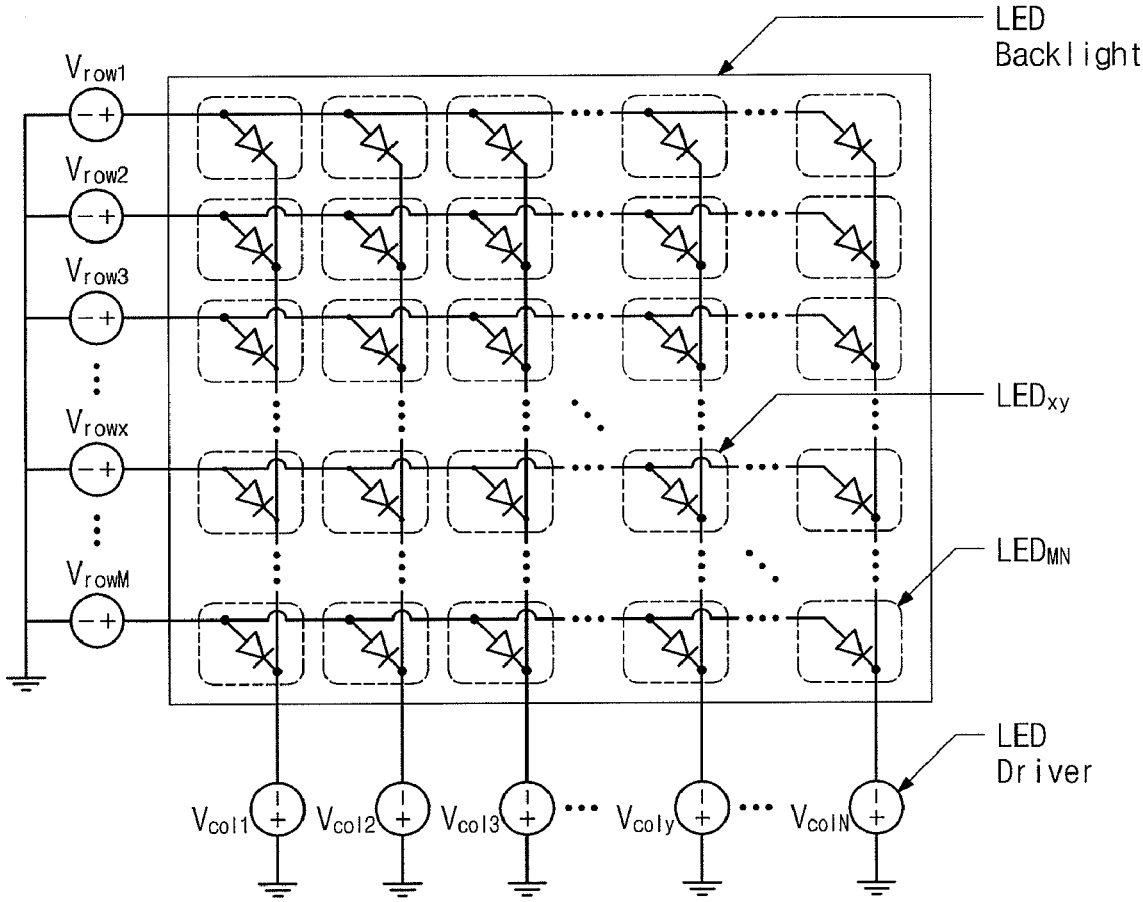
FIG. 14A, FIG. 14B, and FIG. 14C are views for explaining backlight driving by a half-period driving method according to an exemplary embodiment of the present invention.
Figure 14B:
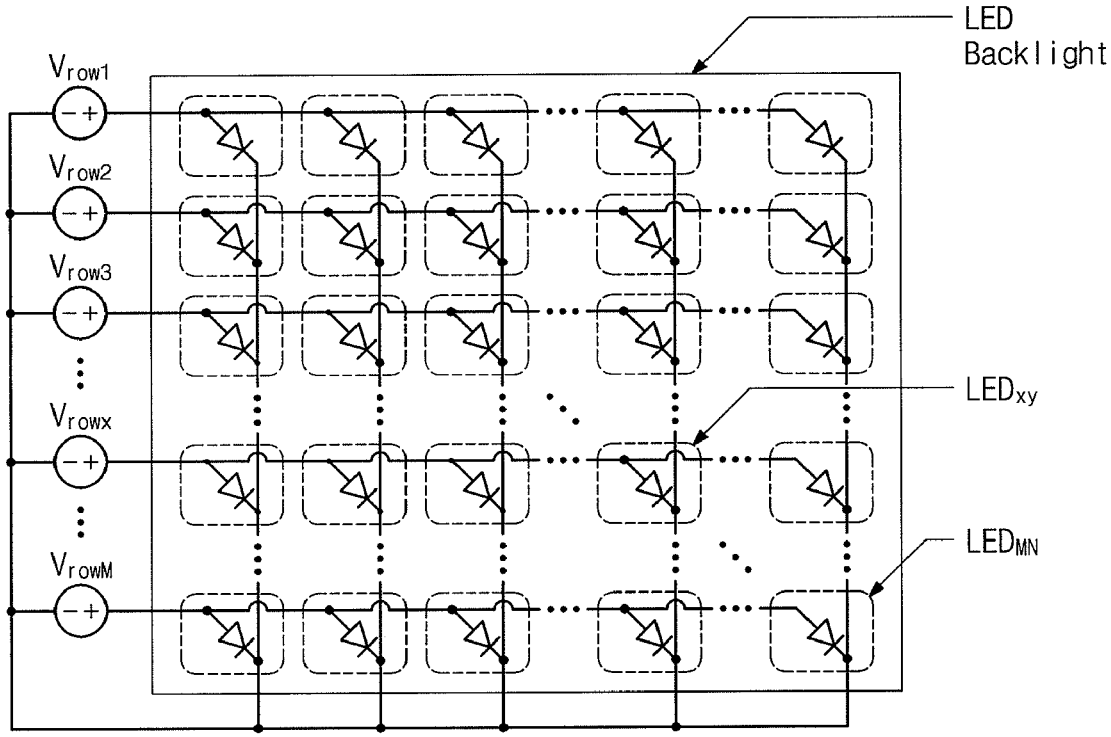
Figure 14C:
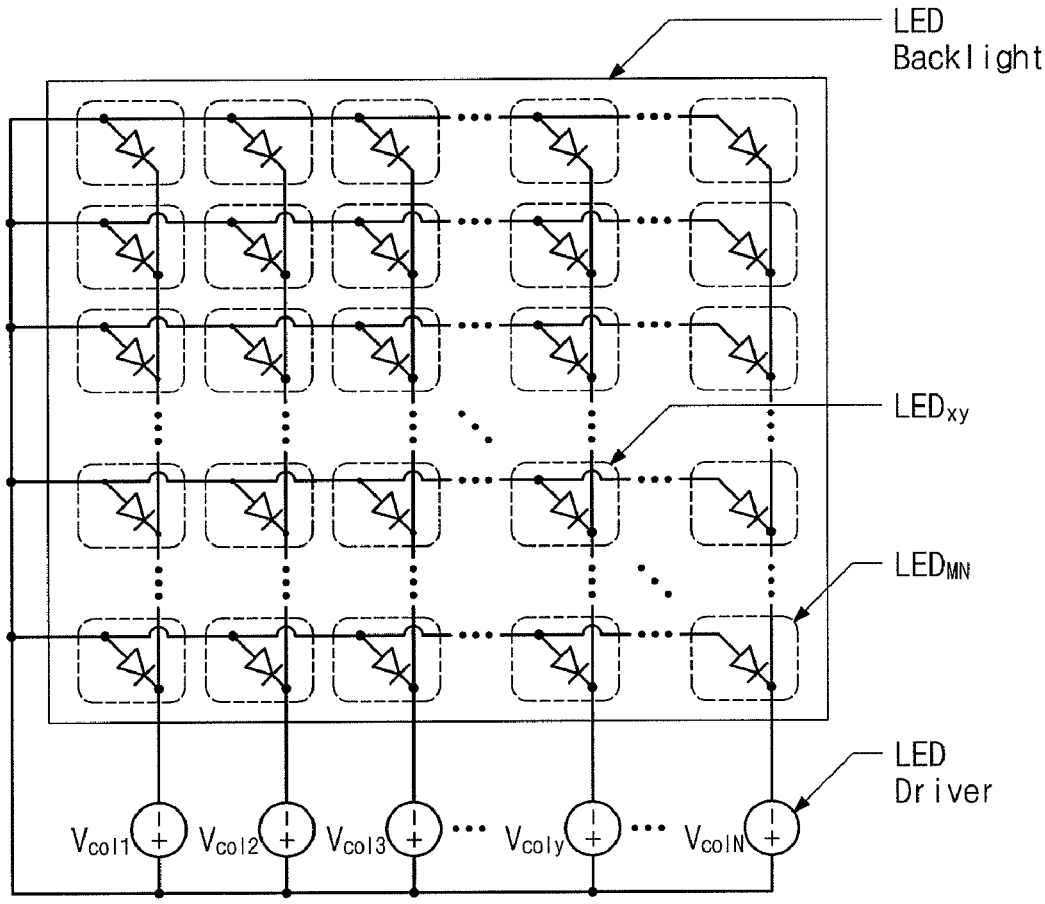

FIG. 14A, FIG. 14B, and FIG. 14C are views for explaining backlight driving by a half-period driving method according to an exemplary embodiment of the present invention. When the half-period driving method is applied to a circuit shown in FIG. 14A, FIG. 14B is an equivalent circuit during row channel driving and the FIG. 14C is an equivalent circuit during column channel driving.

A voltage or current signal transmitted by the row and column driving circuits may be an analog or digital signal. When the analog signal is used as the voltage or current signal, the illumination may be adjusted by the magnitude of the analog signal itself, and when the digital signal is used as the voltage or current signal, the illumination may be adjusted by varying a signal supplying time.

Figure 15A:
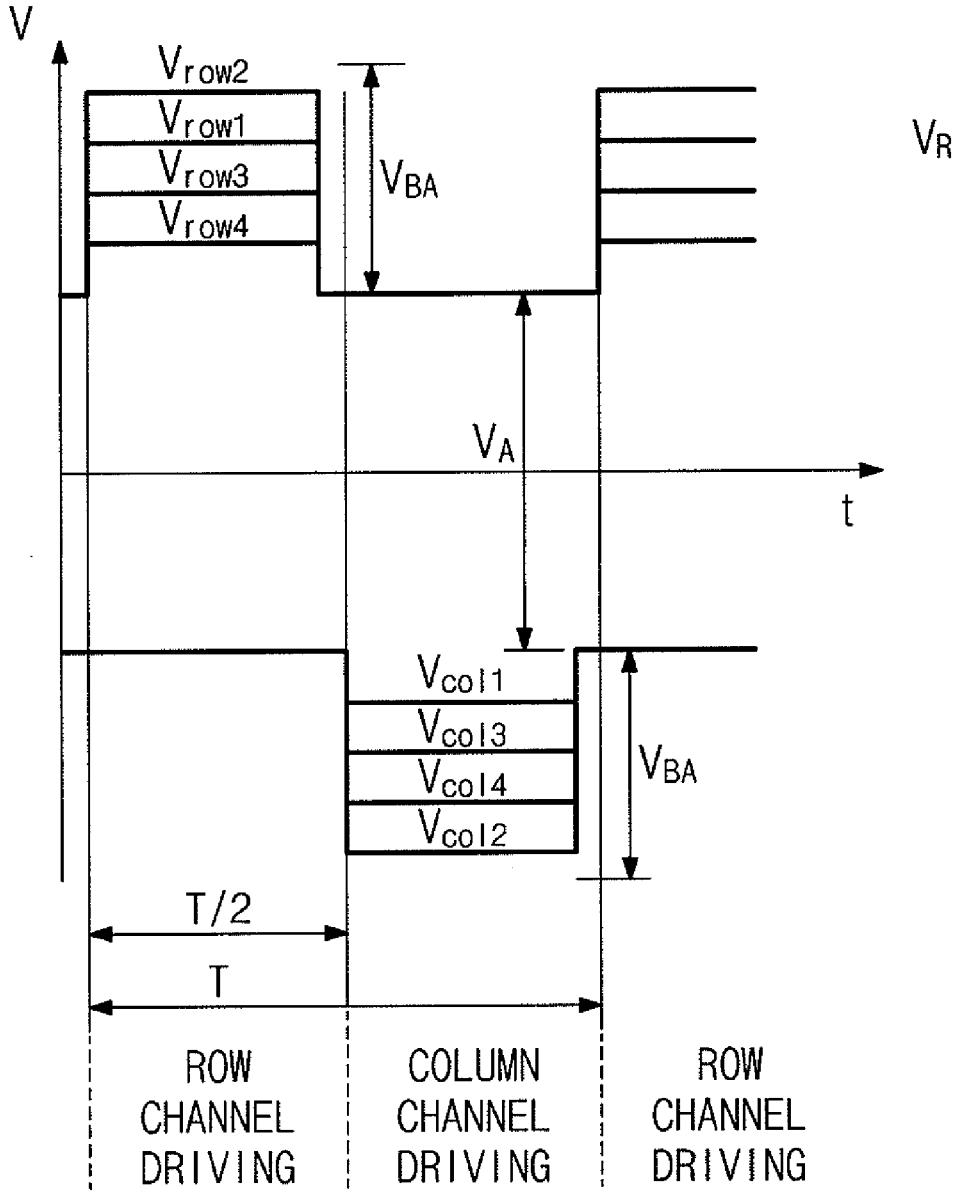
FIG. 15A is a view showing a driving waveform during analog driving by a half-period driving method according to an exemplary embodiment of the present invention.
Figure 15B:
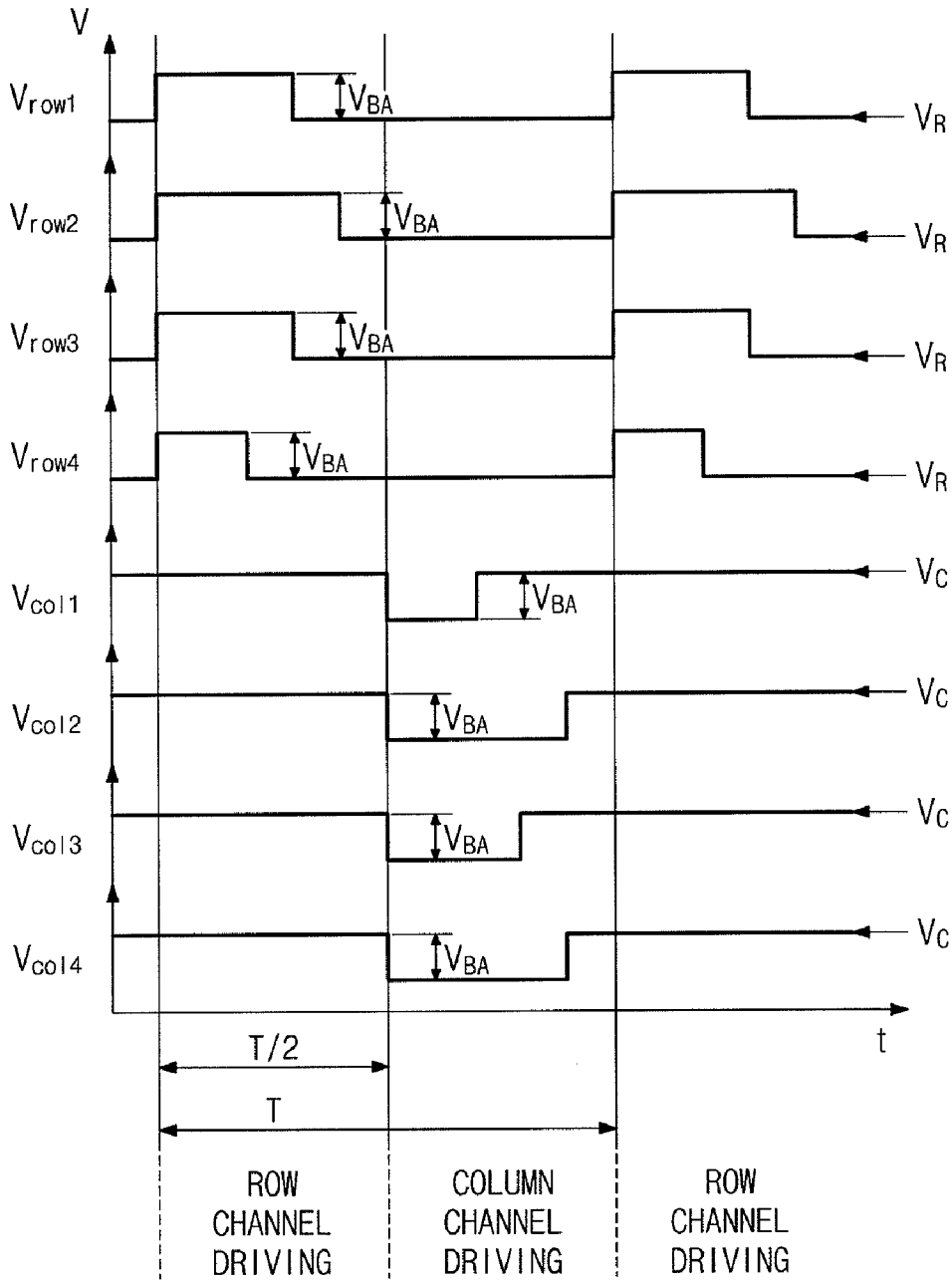
FIG. 15B and FIG. 15C are views showing driving waveforms during digital driving by a half-period driving method according to an exemplary embodiment of the present invention.
Figure 15C:
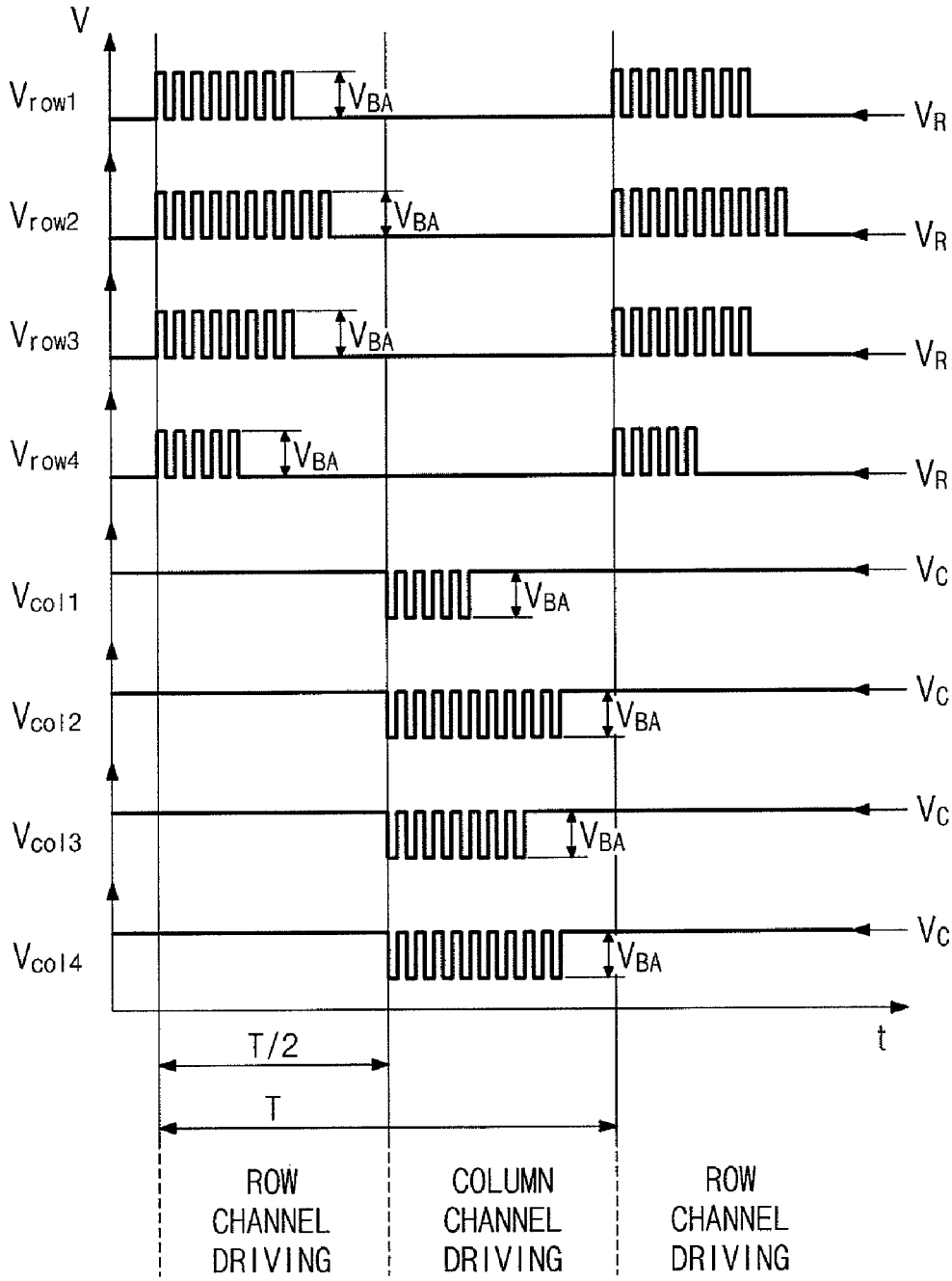

FIG. 15A is a view showing a driving waveform during analog driving by a half-period driving method according to an exemplary embodiment of the present invention, FIG. 15B and FIG. 15C are views showing driving waveforms during digital driving by a half-period driving method according to an exemplary embodiment of the present invention. FIG. 15A, FIG. 15B, and FIG. 15C illustrate views applied to a 4-row by 4-column block structure.

Referring to FIG. 15A, in the analog driving method, the illumination determined according to each row and each column is implemented by adjusting an amplitude of a driving voltage signal or a driving current signal.

In the digital driving method, the illumination determined according to each row and each column is implemented by adjusting a supplying time of a signal having a predetermined amplitude as shown in FIG. 15B. Alternatively, the illumination may be implemented by adjusting the number of pulse signals having a predetermined amplitude and a predetermined period as shown in FIG. 15C.

In the digital driving method, switches may be provided at each row and each column to change the supplying time of the digital signal or to adjust the number of the pulse signals.

Figure 16A:
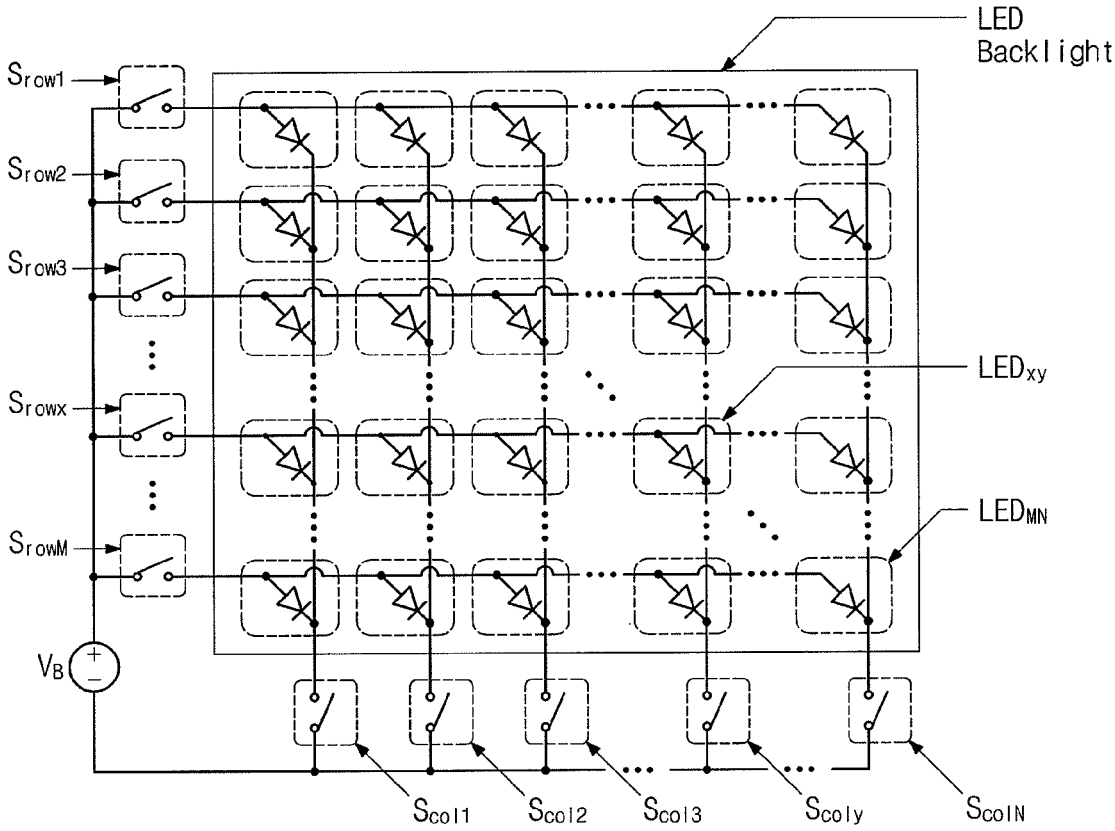
FIG. 16A, FIG. 16B, and FIG. 16C are views each showing a backlight driving circuit using switches at a row driving circuit and a column driving circuit according to an exemplary embodiment of the present invention.
Figure 16B:
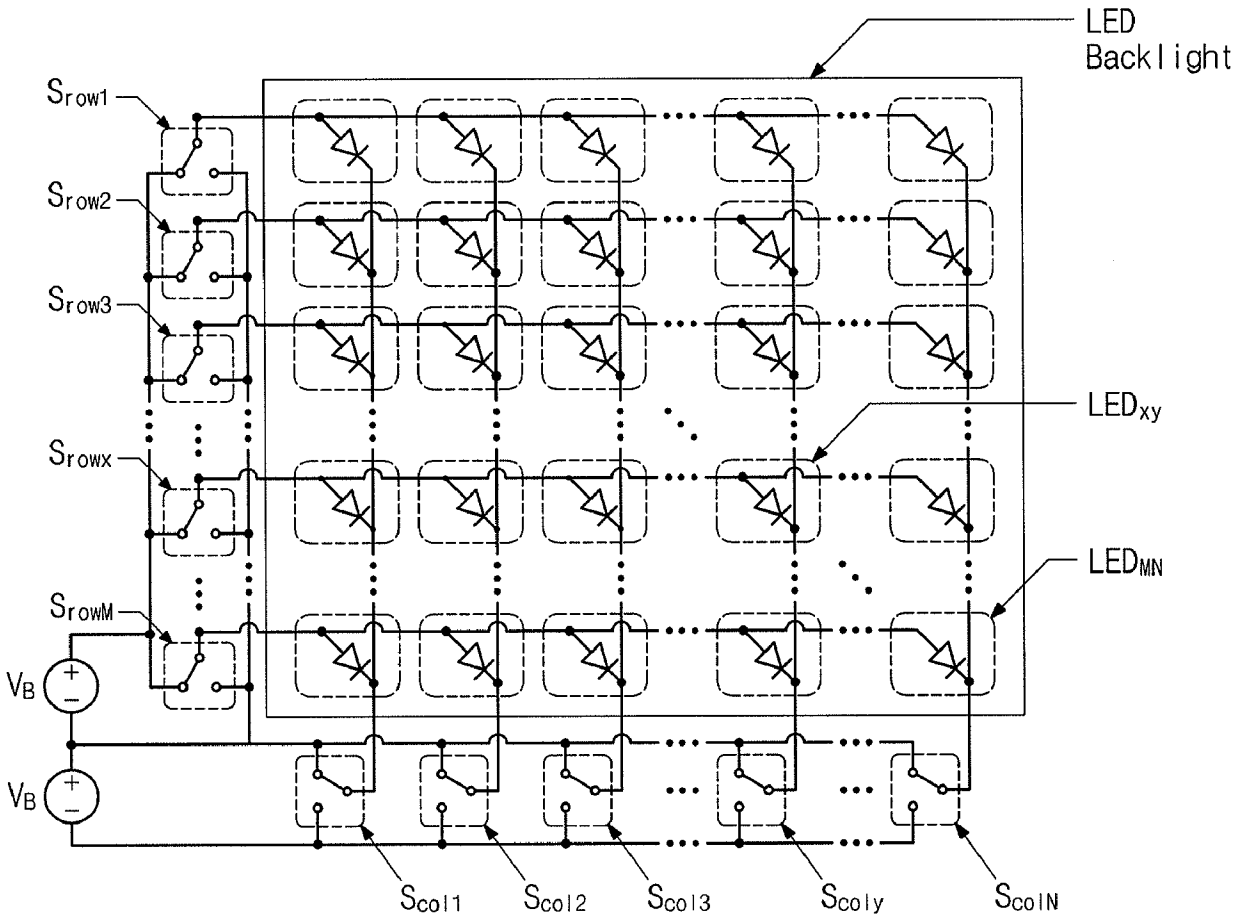
Figure 16C:
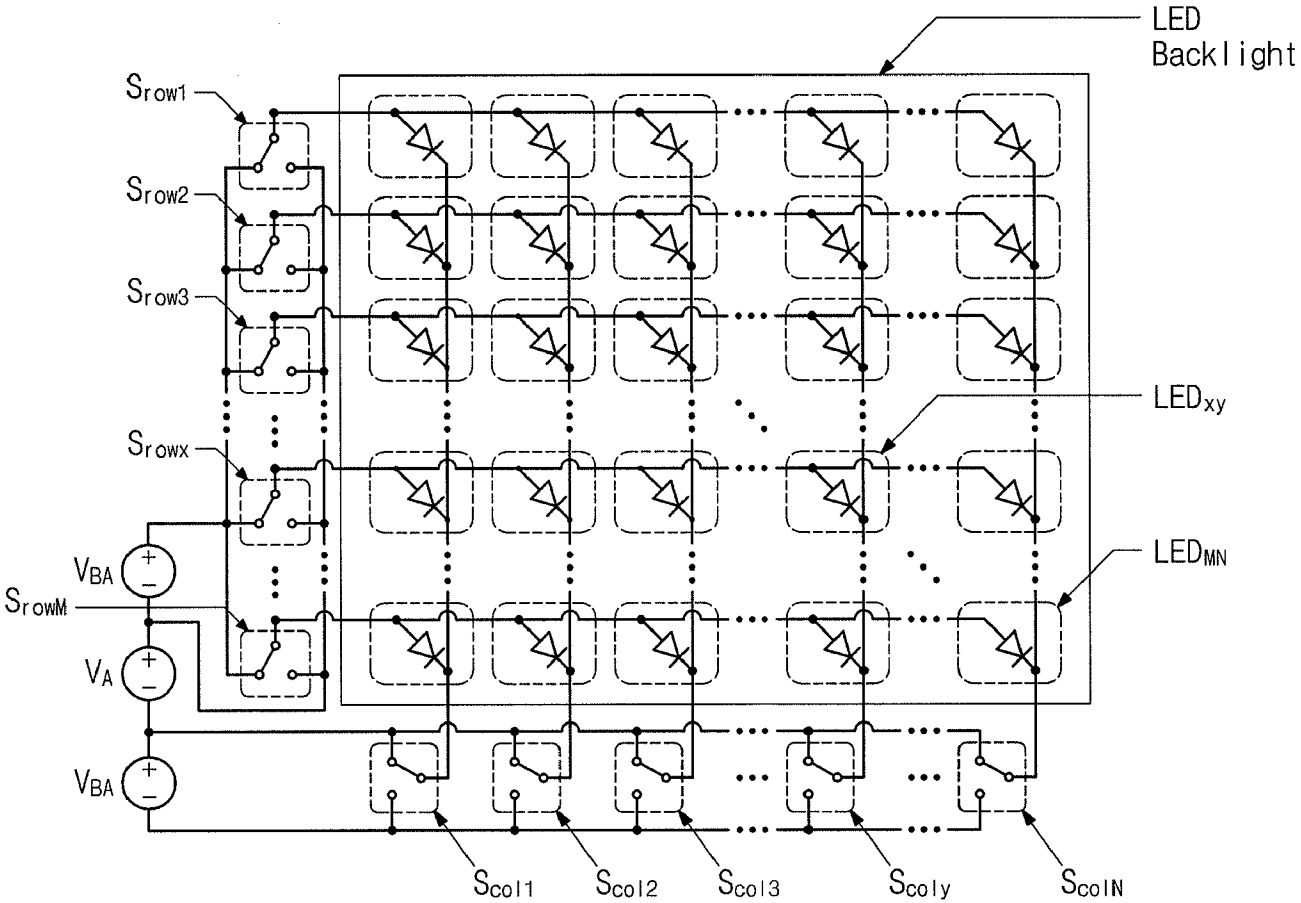
Figure 16D:
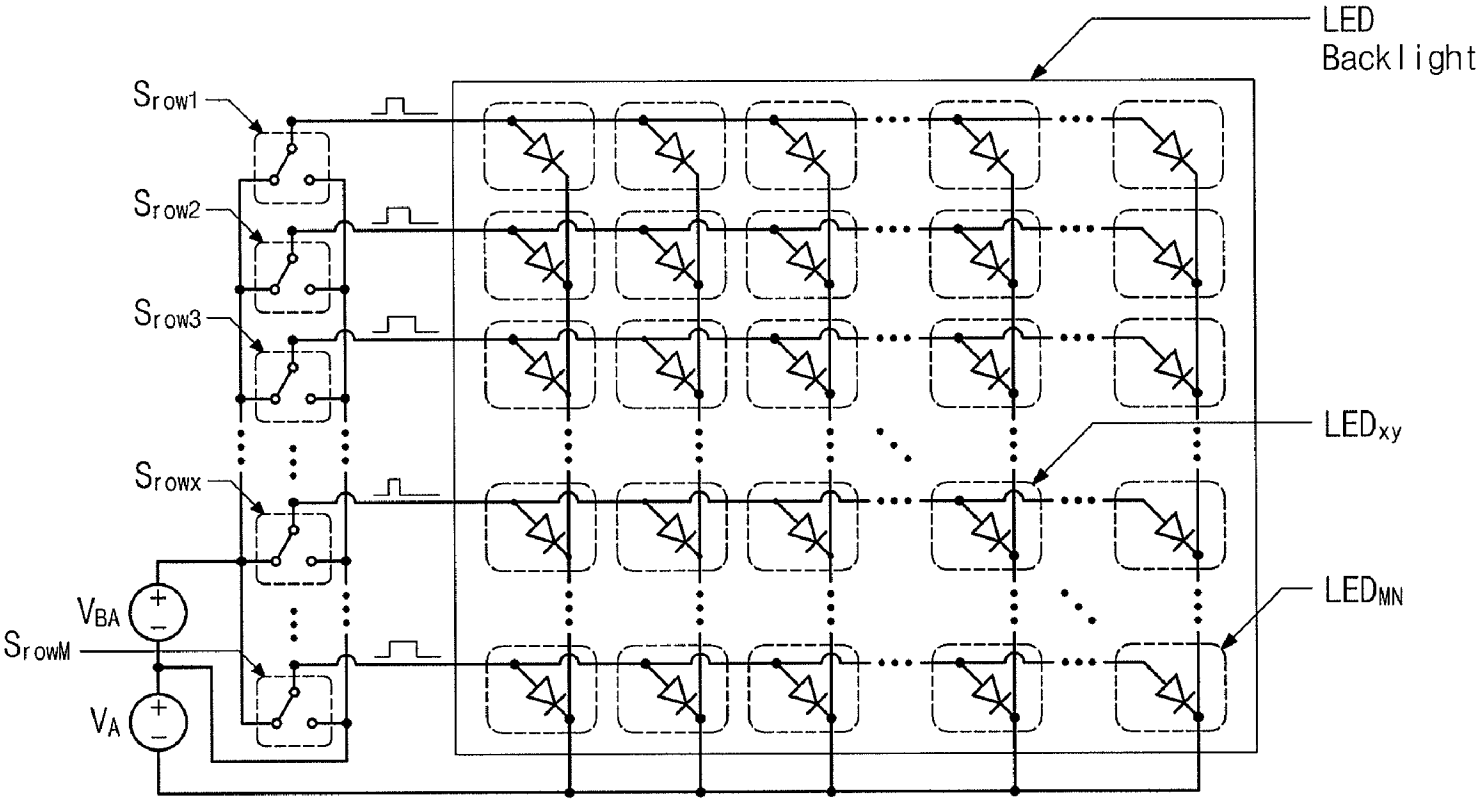
FIG. 16D and FIG. 16E are equivalent circuit diagrams during row channel driving and column channel driving, respectively, in the backlight driving circuit of FIG. 16C according to an exemplary embodiment of the present invention.
Figure 16E:
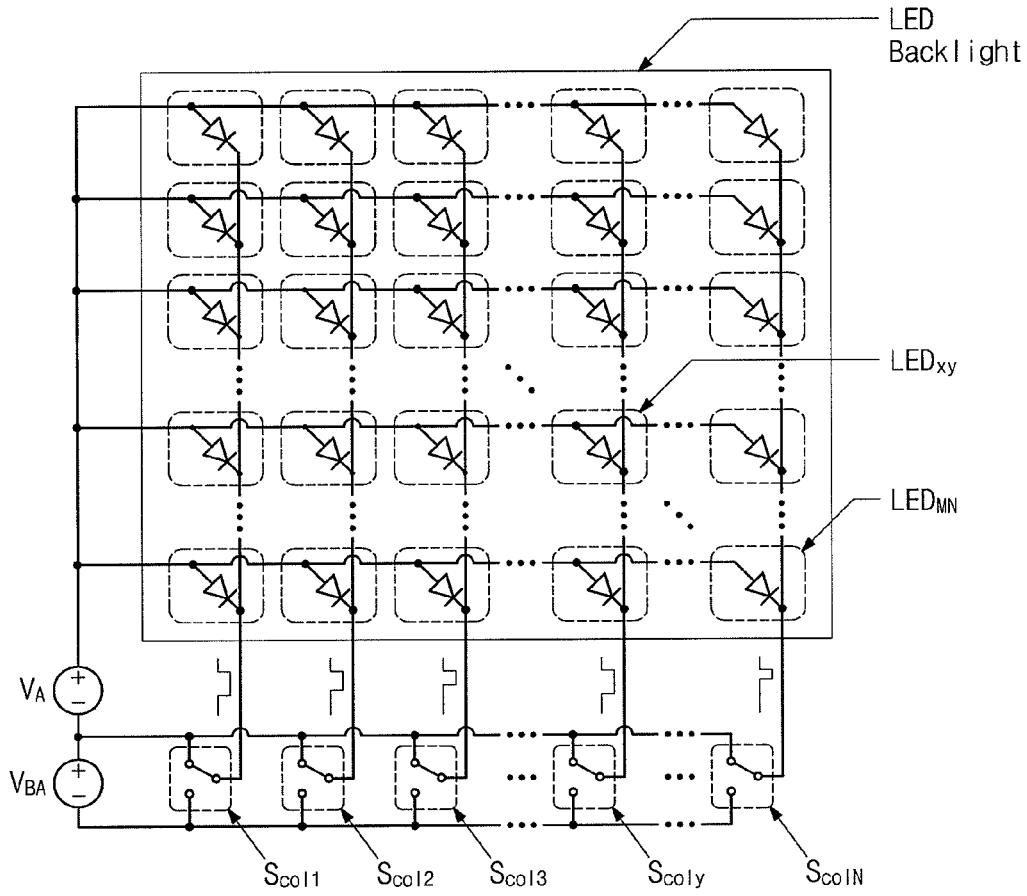

FIG. 16A, FIG. 16B, and FIG. 16C are views each showing a backlight driving circuit using switches at a row driving circuit and a column driving circuit, and FIG. 16D and FIG. 16E are equivalent circuit diagrams during row channel driving and column channel driving, respectively, in the backlight driving circuit of FIG. 16C according to an exemplary embodiment of the present invention.

The number of power supplies is 1, 2, and 3 as in FIG. 16A, FIG. 16B, and FIG. 16C, respectively. Therefore, in at least one embodiment of the present invention, the number of power supplies may be reduced by providing switches at the row driving circuit and the column driving circuit.

Figure 17:
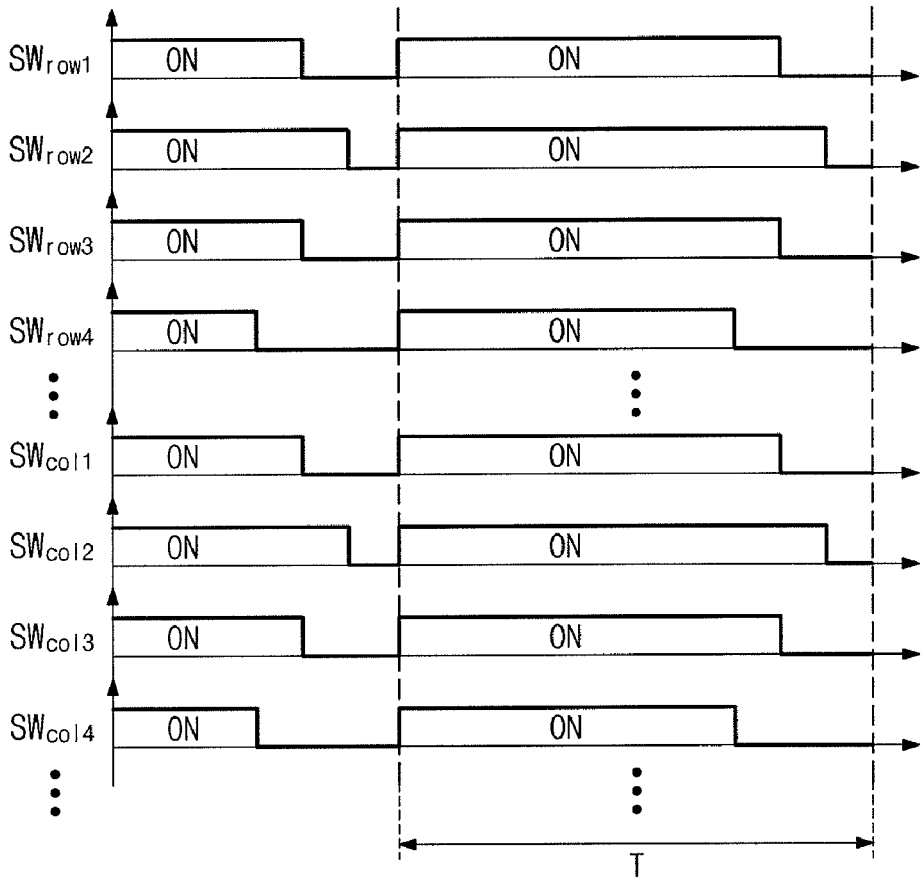
FIG. 17 is a view showing waveforms for switches of the backlight driving circuit of FIG. 16A during digital driving when a half-period driving method is not used.

FIG. 17 shows waveforms for switches of the backlight driving circuit of FIG. 16A. FIG. 17 illustrates a digital driving method in which a half-period driving method is not applied. The LED module of each block is turned on only when the switches at each row and each column corresponding to each block are simultaneously turned on.

At least one embodiment of the present invention improves the contrast ratio of the image of the LCD device and decreases power consumption by the localized dimming method in which adjusted light per block of the backlight unit is transmitted to corresponding pixels.

At least one embodiment of the present invention can decrease the number of driving circuits for driving the backlight unit by transmitting the same row driving signal from the same row driving circuit to blocks in the same row, transmitting the same column driving signal from the same column driving circuit to blocks in the same column, and driving each block by a combination of the row driving signal and the column driving signal.

While the invention has been shown and described with reference to exemplary embodiments thereof, it will be understood by those skilled in the art that various changes in form and details may be made therein without departing from the spirit and scope of the invention.

What is claimed is:

1. A backlight unit of a liquid crystal display device that supplies light to one or more corresponding pixels of a liquid crystal display panel, comprising:

a plurality of blocks, each block including a light emitting diode having first and second distinct terminals, the blocks formed into a matrix shape, wherein the blocks in a row of the matrix are driven by a same row driving signal and the blocks in a column of the matrix are driven by a same column driving signal, to adjust luminance of the light supplied to the corresponding pixels;

a row driving circuit applying the row driving signal to the first terminals of the light emitting diodes in the row; and a column driving circuit applying the column driving signal to the second terminals of the light emitting diodes in the column, wherein illumination of the light emitting diode is adjusted by the column driving circuit in a first duration and by the row driving circuit in a second duration, wherein the row driving circuit applies the row driving signal at a first voltage level during a first part of an image period and then transitions the row driving signal to a second voltage level, wherein the column driving circuit applies the column driving signal at a third voltage level during the first part and then transitions the column driving signal to a fourth voltage level, and wherein the second and third voltages differ from one another and the second and third voltages are in between the first and fourth voltages.

2. The backlight unit of the liquid crystal display device according to claim 1, wherein the row driving signal and the column driving signal are voltage signals, and the light emitting diode is driven by a voltage applied across the light emitting diode by the row driving signal and the column driving signal.

3. The backlight unit of the liquid crystal display device according to claim 1, wherein the row driving signal and the column driving signal are analog signals.

4. The backlight unit of the liquid crystal display device according to claim 1, wherein the row driving signal and the column driving signal are digital signals.

5. The backlight unit of the liquid crystal display device according to claim 4, wherein the row driving signal and the column driving signal have a predetermined amplitude, and illumination of the light emitting diode module is adjusted by a supplying time of the row driving signal and the column driving signal.

6. The backlight unit of the liquid crystal display device according to claim 4, wherein the column driving signal and the row driving signal are pulse signals having a predetermined amplitude and a predetermined period; and illumination of the light emitting diode module is adjusted by the number of the pulse signals.

7. A liquid crystal display device comprising:

a display panel that comprises a plurality of pixels formed into a matrix shape and adjusts transmittance of liquid crystals according to a driving signal applied to the pixels to display an image;

a panel driver that transmits the driving signal to the pixels of the display panel;

a backlight unit that comprises a plurality of blocks formed into a matrix shape and supplies light to at least one of the corresponding pixels, wherein each block includes a light emitting diode having first and second distinct terminals; and a backlight unit driver that comprises a plurality of row driving circuits that transmit a same row driving signal to the blocks belonging to a same row of the backlight unit, and a plurality of column driving circuits that transmit a same column driving signal to the blocks belonging to a same column of the backlight unit, wherein a corresponding one of the row driving circuits applies the row driving signal to the first terminals of the light emitting diodes of a corresponding one of the rows, and wherein a corresponding one of the column driving circuits applies the column driving signal to the second terminals of the light emitting diodes of a corresponding one of the columns, wherein illumination of the light emitting diode is adjusted by the column driving circuit in a first duration and by the row driving circuit in a second duration, wherein at least two of the row driving signals at a first voltage level overlap with one another during a first part of an image period, wherein at least two of the column driving signals at a second voltage level overlap with one another during a second part of the image period that is distinct from the first part, and wherein the first and second voltage levels differ from one another.

8. The liquid crystal display device according to claim 7, wherein the row driving circuits and the column driving circuits transmit voltage signals as the row driving signal and the column driving signal, and the light emitting diode is driven by a voltage applied across the light emitting diode by a signal transmitted from the row driving circuits and the column driving circuits.

9. The liquid crystal display device according to claim 7, wherein the row driving signal and the column driving signal transmitted from the row driving circuits and the column driving circuits are analog signals.

10. The liquid crystal display device according to claim 7, wherein the row driving signal and the column driving signal transmitted from the row driving circuits and the column driving circuits are digital signals.

11. The liquid crystal display device according to claim 10, wherein the row driving signal and the column driving signal transmitted from the row driving circuits and the column driving circuits have a predetermined amplitude, and illumination of the light emitting diode module is adjusted by a supplying time of the row driving signal and the column driving signal.

12. The liquid crystal display device according to claim 10, wherein the row driving signal and the column driving signal transmitted from the row driving circuits and the column driving circuits are pulse signals having a predetermined amplitude and a predetermined period, and illumination of the light emitting diode module is adjusted by the number of the pulse signals.

* * * * *